US005791946A

United States Patent [19]

Mendez

[11] Patent Number: 5,791,946

[45] Date of Patent: Aug. 11, 1998

[54] LAMP HOLDER BASE WITH ARCUATE CONTACT

[76] Inventor: Ian M. Mendez, 2048 Harbour Street, Chomedey, Laval, Quebec, Canada, H7T 2N7

[21] Appl. No.: 586,189

[22] Filed: Jan. 16, 1996

[51] Int. Cl.[6] ..... H01R 4/48

[52] U.S. Cl. ..... 439/860; 439/683

[58] Field of Search ..... 439/682–688, 439/617, 858, 860, 861, 241, 242, 856, 739

[56] References Cited

U.S. PATENT DOCUMENTS

| | | | |
|---|---|---|---|
| 4,210,382 | 7/1980 | Culbertson | 439/685 |
| 4,387,950 | 6/1983 | Guzik et al. | 439/686 |
| 4,752,247 | 6/1988 | Warners | 439/688 |
| 4,917,635 | 4/1990 | Landries et al. | 439/685 |
| 5,120,242 | 6/1992 | Greiler et al. | 439/683 |
| 5,263,881 | 11/1993 | Henrici et al. | 439/683 |

*Primary Examiner*—Gary F. Paumen
*Assistant Examiner*—Brian J. Biggi
*Attorney, Agent, or Firm*—Eric Fincham

[57] ABSTRACT

There is provided a contact member for use in a lamp socket and particularly suitable for round terminal pins, the contact member and a recess for holding the contact member having a generally inverted V-shaped configuration, the contact member having a pair of opposed concave portions to receive the terminal pin of the lamp, the concave portions being flexible and biased so as to maintain good contact with the contact pin. The arrangement permits the miniaturization of the socket while also assuring excellent electrical contact between the contact member and the terminal pin ever after repeated usages.

6 Claims, 3 Drawing Sheets

LAMP HOLDER BASE WITH ARCUATE CONTACT

FIELD OF THE INVENTION

The present invention relates to electrical sockets and more particularly, relates to a socket and contact member for a lamp.

BACKGROUND OF THE INVENTION

The use of sockets to receive lamps is well known in the art and many different types of configurations have been proposed. For many years, various screw type and bayonet type contact arrangements were common in the art as the number and different types of lamps which were utilized were somewhat limited. Recently, many different types of lamps are being designed and available commercially including various types of halogen lights and other energy saving lamps. Frequently, these lamps are miniaturized and the base available both for the lamp and the associated circuitry are somewhat limited.

Recently, low voltage lamps using round terminal pins have become standard for certain applications particularly for miniature halogen lamps. The lamps themselves are relatively small and it is thus desirable that the socket and associated contacts be miniaturized. To date, this has presented a problem since the contact must be biased into contact with the terminal pin to ensure proper electrical contact. If one does not have proper electrical contact, there is the danger of air spaces with associated arcing. This can lead to hazardous conditions. To date, in order to attempt to overcome the problems of miniaturization, the prior art has suggested the use of compression springs to maintain proper electrical contact. However, compression springs change with temperature and this can in itself present problems.

A further solution which has been practiced in the art in order to overcome the problems is the use of screws to ensure proper electrical contact. Naturally, this becomes very inconvenient and acceptance of this solution has not been widespread.

Other problems which have been associated with the sockets and contact members include a lessening of the contact pressure after a number of insertions. This lessening of the pressure can again lead to the problems mentioned above.

SUMMARY OF THE INVENTION

It is therefore an object of the present invention to provide a contact member suitable for use with a relatively small lamp socket, the contact member being adapted to securely contact the terminal pins from the lamp while minimizing space requirements.

It is a further object of the present invention to provide for a lamp socket suitable for use with miniaturized lamps.

It is a further object of the present invention to provide a lamp socket and associated contact members wherein the contact members can flex and maintain a pressure against lamp terminal pins.

According to one aspect of the present invention, there is provided a contact member for a lamp socket adapted to receive a generally circular terminal pin, the contact member comprising a first pin contacting segment and a second pin contacting segment, each of the first and second pin contacting segments having an arcuate concave portion in a generally facing relationship, each of the arcuate concave portions being adapted to partially encircle a terminal pin, a first biasing segment extending from a first end of the first pin contacting segment, a second biasing segment extending from a first end of the second pin contacting segment, and a loop segment extending between a second end of the first pin contacting segment and a second end of the second pin contacting segment, the arrangement being such that at least one of the first and second biasing segments extend in a first direction, and the loop segment extends in a second direction, wherein the first and second directions are such to form a generally V-shaped configuration with the loop segment forming a first arm of the V-shaped configuration and at least one of the first and second biasing segments forming a second arm of the V-shaped configuration.

According to a further aspect of the present invention, there is provided a contact member for a lamp socket, the contact member comprising a first pin contacting segment having first and second ends, an arcuate section intermediate the first and second ends, the arcuate section having a concave configuration to partially encircle a contact pin, means at the first and second ends of the first pin contacting segment contacting the side wall of the recess to hold the first pin contacting segment in a fixed relationship while permitting flexing of the arcuate portion, a second pin contacting segment having first and second ends and an arcuate section therebetween having a concave configuration adapted to partially encircle a terminal pin, the arcuate section of the second pin contacting segment being in a generally facing relationship with respect to the arcuate section of the first pin contacting segment, and means associated with the arcuate portion of the second pin contacting segment to contact the side wall of the recess whereby the second pin contacting segment has less flexibility than the first pin contacting segment.

In a further aspect of the invention, there is provided a socket for use with contact members, the socket comprising an annular disk having a side wall and first and second surfaces, one of the surfaces having a pair of recesses formed therein with each recess being defined by a recess wall, each of the recesses having a central recess portion, a first side recess portion extending therefrom, a second side recess portion extending therefrom such that the recess has a generally V-shaped configuration, a contact member for each of the recesses, each of the contact members having a first pin contacting segment and a second pin contacting segment, each of the first and second pin contacting segments having an arcuate concave portion in a generally facing relationship, each of the arcuate concave portions being adapted to partially encircle a terminal pin, a first biasing segment extending from a first end of the first pin contacting segment into a first side recess, a second biasing segment extending from a first end of the second pin contacting segment and a loop segment joining a second end of the first pin contacting segment and a second end of the second pin contacting segment, the loop segment fitting in a second one of the side recess portions, the second biasing segment adapted to abut the recess wall, the first pin contacting segment having a greater flexibility than the second pin contacting segment such that when a terminal pin is inserted between the arcuate concave portions, the first pin contacting segment flexes prior to the second pin contacting segment.

In greater detail, the socket and contact member of the present invention are particularly adapted for round terminal pins although other shapes can also be accommodated and fall within the scope of the invention. In particular, shapes of terminal pins which are a variation of the round or circular cross section could easily be accommodated with suitable modifications including oval, semi circular, etc.

The socket is conventionally formed of a ceramic material although any suitable material may be used in the practice of the present invention. In one of the preferred embodiments, the socket is of a circular configuration since this is the most common requirement. However, it will be apparent to those knowledgeable in the art that other configurations can also be employed.

The socket will have at least one recess and normally two recesses for most conventional lamp sockets. The recesses are formed within a surface and are adapted to receive the contact member and provide for electrical communication from the contact member to the power supply or other electrical element.

In a preferred embodiment of the present invention, the recess has a somewhat V-shaped configuration having a central recess portion and a pair of side recess portions for reasons which will become apparent hereinbelow. The recess is configured and sized so as to ensure that certain biasing forces are applied to the contact member to ensure proper electrical contact between the contact member and the contact pin. Naturally, the functioning of the recess and wall defining the recess to apply these forces could be accomplished by use of suitable posts or the like which would be equivalent to the present invention.

The socket may have conventional features such as apertures for securing the socket and/or receiving electrical contacts.

As will be described in the preferred embodiments, a conventional socket includes provision for two contact members and such will be described herein. However, it is within the scope of the invention to use one or more contact members as may be appropriate.

The contact member of the present invention is preferably formed as a one piece unit for ease of manufacture although the general principles of the present invention could be practiced utilizing a two component contact member. The contact member has a pair of pin contacting segment which are in a generally opposed relationship. Each pin contacting segment has a concave portion, the two facing concave portions defining the pin receiving area. If desired, the pin receiving area may have a slightly funnel shaped configuration to facilitate the insertion of the terminal pin therebetween.

Preferably, one of the pin contacting segments is of a greater length than the other of the pin contacting segments, the arrangement being such that the longer of the pin contacting segments provides a greater flex therein. As will be appreciated, it is desirable to maintain a constant pressure on the terminal pins and to this end, when the pin is inserted in the pin receiving area, one of the pin contacting segments is adapted to flex a little bit more easily that the other of the pin contacting segments. This allows for accommodation of slightly different pin sizes and pin separation.

The second of the pin contacting segments preferably is sized to have a shorter unsupported length or other means to increase the resistance thereof to flexing. However, it is still arranged to have some flex after a certain amount of force is exerted thereon.

Naturally, the contact members normally have a wire or like element secured thereto to provide for electrical communication. Various means may be utilized for attaching the wire including mechanical attachments, soldering, welding, etc.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
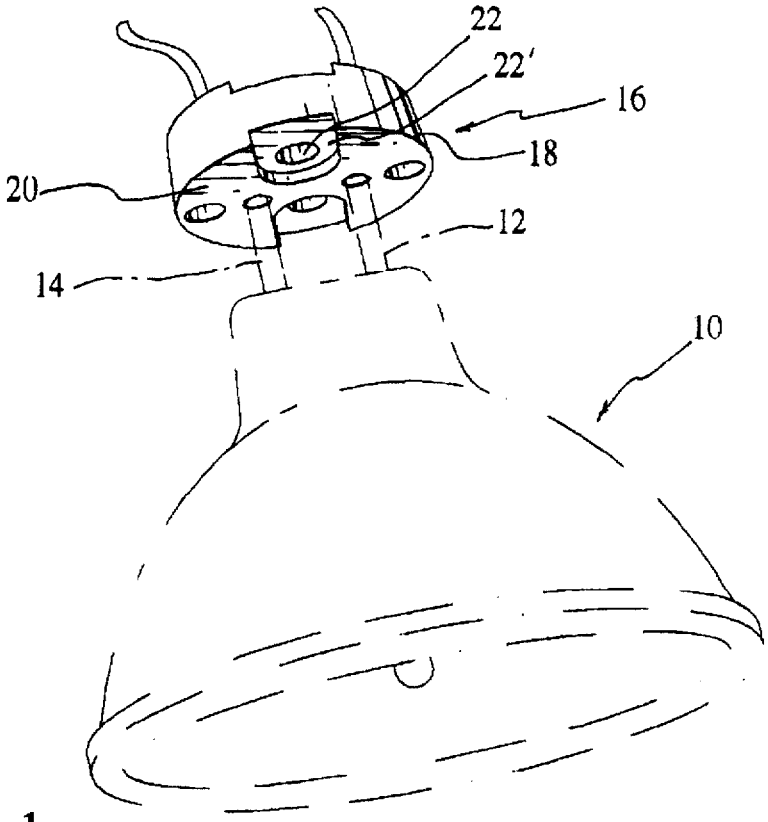
FIG. 1 is a perspective view of a socket and associated contact members and a lamp to be used with the socket.
Figure 2:
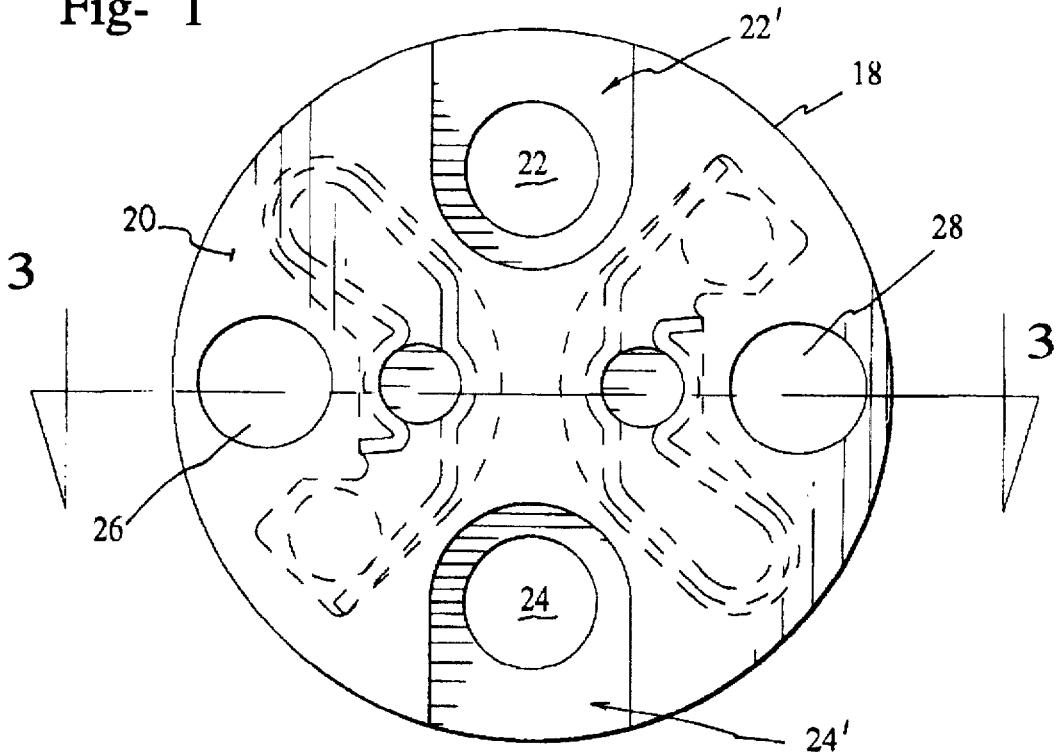
FIG. 2 is a bottom plan view of the socket and showing in outline the contact members having terminal pins inserted therein.
Figure 3:
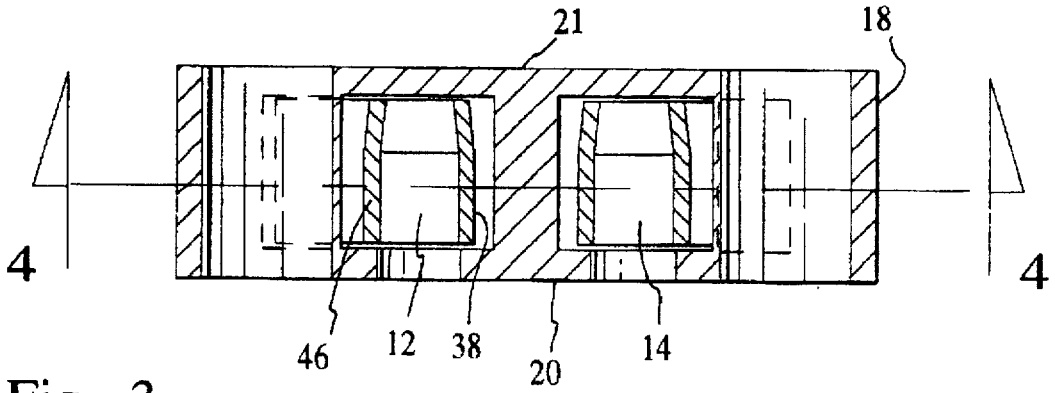
FIG. 3 is a sectional view taken along the lines 3—3 of FIG. 2.

Referring to the drawings in greater detail, and by reference characters thereto, there is shown in FIG. 1 a lamp 10 of the mini halogen type and which lamp 10 includes a pair of circular contact pins 12 and 14. A generally disk shaped socket 16 having an exterior wall 18 and a pair of opposed surfaces (upper surface 20 and bottom surface 21). Socket 16 is shown in greater detail in FIG. 2 which will now be referred to.

Socket 16 includes a first pair of apertures 22 and 24 which typically may be used for mounting the socket. Recesses 22' and 24' are provided in surface 20 about apertures 22 and 24 respectively.

A second pair of apertures 26 and 28 are provided to receive electrically conductive members for electrical contact if required under certain circumstances. In the embodiment illustrated herein, they are not utilized.

Formed with surface 20 of socket 16 are a pair of recesses 30 and 30'. Recesses 30 and 30' are substantially identical and thus, only one will be described herein.

Recess 30 has an arcuate wall section 68 located near the center of the socket and which is of a slightly concave configuration. At one end of wall section 68 it merges with a straight wall section 70. In turn, straight wall section 70 reverses through 180° with a concave wall section 72. In turn, a straight wall section 74 substantially parallel to wall section 70 merges with a concave wall section 76 which is in a facing relationship with concave section 68. An abutment 78 forms a stop member for reasons which will become apparent hereinbelow. There is provided a further straight wall section 80, and end wall section 82 and a straight wall section 84 which merges with the other end of arcuate wall section 68. The arrangement thus provides a central recess area generally designated by reference numeral 62 and a first side recess portion 64 and a second side recess portion 66.

Mounted in recess 30 is a contact member which comprises a first biasing end segment 34 which merges with a pin contacting segment 36. As will be seen, pin contacting segment 36 includes an arcuate portion generally designated by reference numeral 38 and which is adapted to contact one side of pin 14. Pin contacting segment 36 then continues on with a second segment 40 which merges with a return loop segment 42 which reverses direction through 180°. Loop segment 42 in turn is connected to a relatively straight segment 44. A pin contacting segment 46 is mounted opposite pin connecting segment 36; in the illustrated embodiment, pin contacting segment 46 is of an arcuate configuration to contact the other side of pin 14. An end biasing segment 48 forms a continuation of pin contacting segment 46 and is formed to be in connect with abutment 78.

Figure 4:
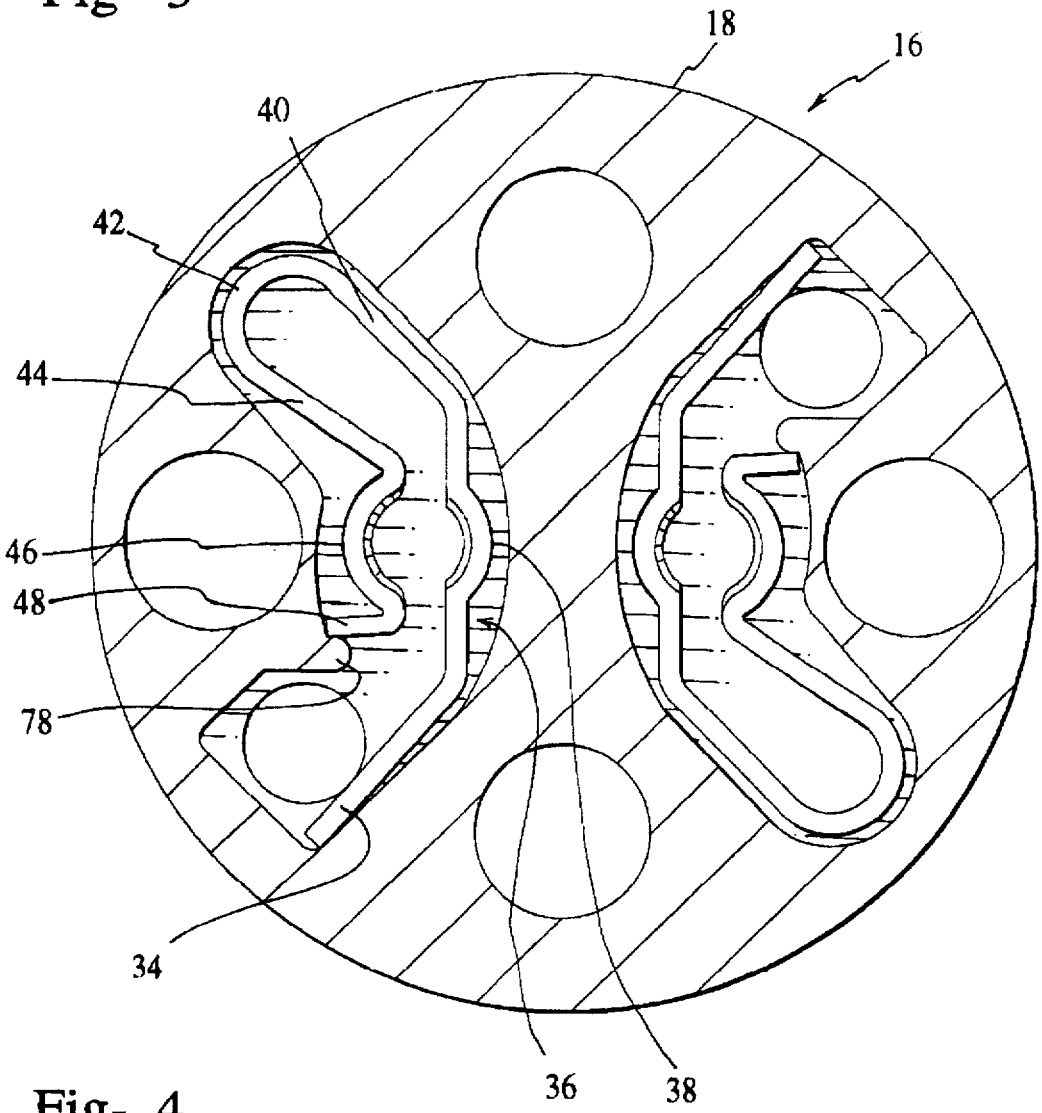
FIG. 4 is a sectional view taken along the lines 4—4 of FIG. 3.
Figure 5:
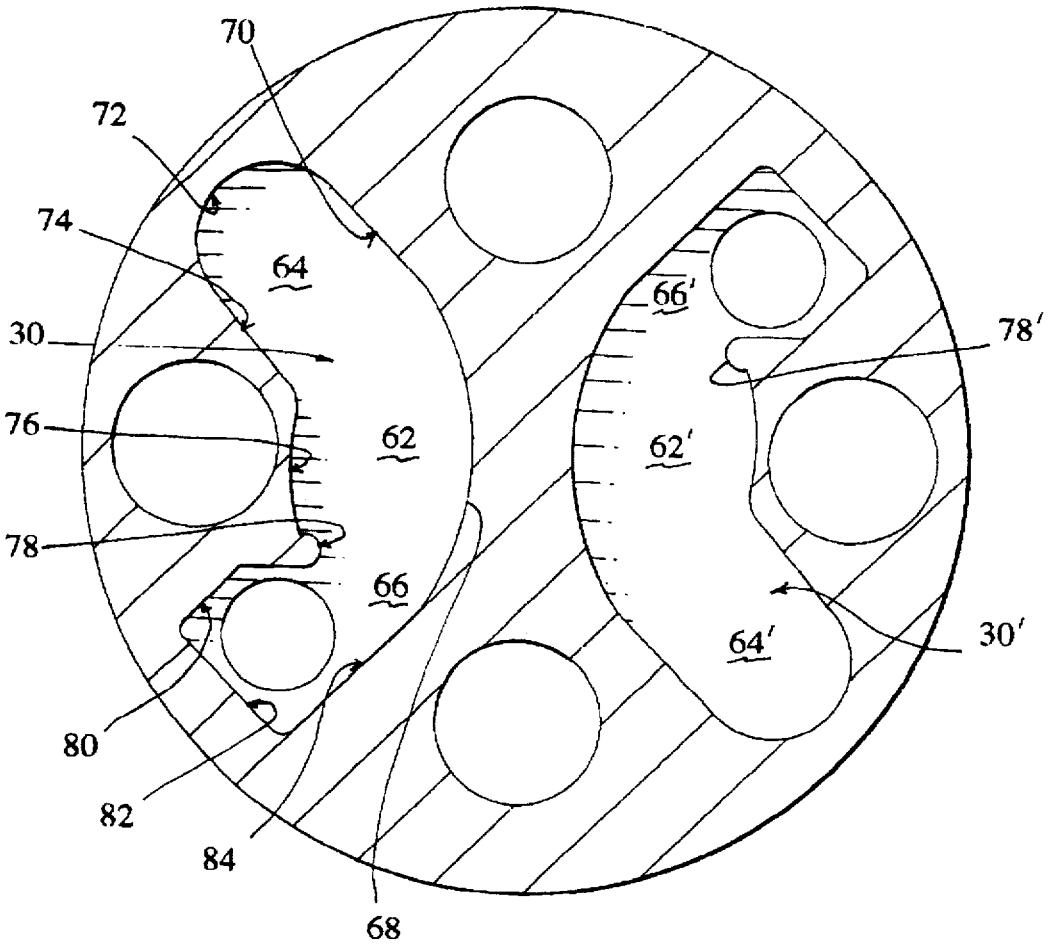
FIG. 5 is a view identical to FIG. 4 but with the contact members removed.

As will be seen in FIG. 4, pin contacting segment 36 is designed to be spaced from arcuate wall section 68. Second segment 40, return loop segment 42 and straight segment 44 fit within the area of side recess 64. Second pin contacting segment 46 is mounted within central recess area 62 while end biasing segment 48 rests against abutment 78 to maintain the contact member in the desired position and to provide for a controlled flex as will be discussed hereinbelow.

As will be noted in the drawings, arcuate portions 38 and 46 may have a slight funnel shape configuration to facilitate insertion of the pin therebetween.

As will be understood, there can be variance in the size and shape of the pins and the contact member and socket is adapted to respond to these. When the pin is inserted between the arcuate portions, relatively long pin contacting segment 36 will tend to flex first until arcuate portion 38 contacts wall 68. Pin contacting segment 46 will then tend to flex; due to the configuration, it has a higher resistance to flexing and tends to exert pressure to ensure that contact between the pin and arcuate sections is maintained.

It will be understood that the above described embodiments is for purposes of identification only and that changes and modifications may be made thereto without departing from the spirit and scope of the present invention.

I claim:

1. A contact member for a lamp socket adapted to receive a generally circular terminal pin, said contact member comprising a first pin contacting segment and a second pin contacting segment, each of said first and second pin contacting segments having an arcuate concave portion in a generally facing relationship, each of said arcuate concave portions being adapted to partially encircle a terminal pin, a first biasing segment extending from a first end of said first pin contacting segment, a second biasing segment extending from a first end of said second pin contacting segment, said second biasing segment being shorter than said first biasing segment, and a loop segment extending between a second end of said first pin contacting segment and a second end of said second pin contacting segment, the arrangement being such that said first and second biasing segments extend in a direction angled with respect to a plane extending between said arcuate concave portions and being spaced equally therefrom, and said loop segment extends in a second direction also angled with respect to said plane, wherein said first and second directions are such to form a generally V-shaped configuration with said concave portions forming a base thereof and with said loop segment forming a first arm of said V-shaped configuration and at least one of said first and second biasing segments forming a second arm of said V-shaped configuration.

2. The contact member of claim 1 wherein said arcuate concave portions have a configuration conforming to an arc segment of a circle.

3. The contact member of claim 1 wherein said terminal pins are circular in cross section.

4. A socket arrangement having contact members, said socket comprising an annular disk having a side wall and first and second surfaces, one of said surfaces having a pair of recesses formed therein, each recess being defined by a recess wall, each of said recesses having a central recess portion, a first side recess portion extending therefrom, a second side recess portion extending therefrom such that said recess has a generally V-shaped configuration, a contact member for each of said recesses, each of said contact members having a first pin contacting segment and a second pin contacting segment, each of said first and second pin contacting segments having an arcuate concave portion in a generally mutually facing relationship, each of said arcuate concave portions being adapted to partially encircle a terminal pin, said first pin contacting segment including first and second straight portions extending from either end of said concave portion, a first biasing segment extending from said first straight portion of said first pin contacting segment into a first side recess portion, a second biasing segment extending from a first end of said second pin contacting segment and a loop segment joining a second end of said first pin contacting segment and a second end of said second pin contacting segment, said loop segment fitting in a second one of said side recess portions, said second biasing segment adapted to abut said recess wall, said first pin contacting segment being spaced from said recess wall and having a greater length than said second pin contacting segment to thereby have a greater flexibility than said second pin contacting segment such that when a terminal pin is inserted between said arcuate concave portions, said first pin contacting segment flexes prior to said second pin contacting segment.

5. The socket of claim 4 further including an aperture formed in said recess adapted to receive a wire.

6. The socket of claim 5 wherein said aperture is proximate to said first biasing segment extending from said first pin contacting segment.

* * * * *